US007540388B2

(12) United States Patent
Silver

(10) Patent No.: US 7,540,388 B2
(45) Date of Patent: Jun. 2, 2009

(54) ARTIFICIAL FEEDING NIPPLE TIP WITH VARIABLE FLOW CONSTRUCTION

(75) Inventor: Brian H. Silver, Cary, IL (US)

(73) Assignee: Medela Holding AG (CH)

( * ) Notice: Subject to any disclaimer, the term of this patent is extended or adjusted under 35 U.S.C. 154(b) by 0 days.

(21) Appl. No.: 11/122,950

(22) Filed: May 5, 2005

(65) Prior Publication Data

US 2005/0258123 A1 Nov. 24, 2005

Related U.S. Application Data

(60) Provisional application No. 60/568,884, filed on May 7, 2004.

(51) Int. Cl.
*A61J 11/00* (2006.01)

(52) U.S. Cl. ..... 215/11.1; 215/11.4

(58) Field of Classification Search ..... 215/11.1, 215/11, 5, 11.4, 11.5
See application file for complete search history.

(56) References Cited

U.S. PATENT DOCUMENTS

| | | | | | |
|---|---|---|---|---|---|
| 1,545,436 | A | | 7/1925 | McGeary | |
| 1,590,152 | A | | 6/1926 | Dreyfus | |
| 1,632,854 | A | | 6/1927 | Rogers | |
| 1,656,157 | A | * | 1/1928 | Correnti | 215/11.1 |
| 1,672,466 | A | | 6/1928 | Oshman et al. | |
| 1,672,734 | A | | 6/1928 | Reilly | |
| 1,989,060 | A | | 1/1935 | Liddick | |
| 2,060,212 | A | | 11/1936 | Herstein | |
| 2,063,424 | A | * | 12/1936 | Eimer | 215/11.1 |
| 2,321,236 | A | | 6/1943 | Parkin | |
| 2,442,656 | A | * | 6/1948 | Less | 215/11.4 |
| 2,513,896 | A | * | 7/1950 | Searer | 215/11.5 |
| 2,588,069 | A | * | 3/1952 | Allen | 215/11.1 |
| 2,630,118 | A | * | 3/1953 | Casey | 215/11.4 |
| 2,638,094 | A | | 5/1953 | Kronish | |
| 2,655,920 | A | | 10/1953 | Cronin | |
| 2,661,001 | A | * | 12/1953 | Benjamin et al. | 215/11.5 |
| 2,736,446 | A | | 2/1956 | Raiche | |
| 2,774,500 | A | * | 12/1956 | Budiani | 215/11.1 |
| 2,825,479 | A | | 3/1958 | Litzie | |
| 2,889,829 | A | | 6/1959 | Tannenbaum et al. | |
| 2,954,030 | A | * | 9/1960 | Jozwiak | 215/11.1 |
| 3,139,064 | A | | 6/1964 | Harle | |
| 3,190,288 | A | | 6/1965 | Butler et al. | |
| 3,193,125 | A | | 7/1965 | Fischer | |
| 3,424,157 | A | | 1/1969 | Di Paolo | |

(Continued)

FOREIGN PATENT DOCUMENTS

EP 0 300 786 A2 1/1989

(Continued)

OTHER PUBLICATIONS

European Search Report issued for EP 05746795.3 on Mar. 10, 2008.

*Primary Examiner*—Sue A Weaver
(74) *Attorney, Agent, or Firm*—McDonnell Boehnen Hulbert & Berghoff LLP

(57) ABSTRACT

An artificial baby-feeding nipple has one or more openings formed therein for conveying fluids through the nipple. The nipple is configured and formed of a material which permits changeable flow rates in response to changing suckling conditions.

20 Claims, 5 Drawing Sheets

U.S. PATENT DOCUMENTS 3,530,979 A 9/1970 Merrill, Jr., et al.
3,593,870 A 7/1971 Anderson
3,645,413 A 2/1972 Mitchell
3,650,270 A 3/1972 Frazier
3,661,288 A 5/1972 Noll
3,718,140 A * 2/1973 Yamauchi ..... 215/11.1
3,777,753 A 12/1973 Kesselring et al.
3,779,413 A 12/1973 Pickerell et al.
3,787,993 A 1/1974 Lyon
3,790,016 A * 2/1974 Kron ..... 215/11.1
3,790,017 A 2/1974 Fitzpatrick et al.
3,858,741 A 1/1975 Smith, Sr.
4,006,836 A 2/1977 Micallef
4,195,638 A 4/1980 Duckstein
4,238,040 A 12/1980 Fitzpatrick
4,619,271 A 10/1986 Burger et al.
4,623,069 A * 11/1986 White ..... 215/11.1
4,676,386 A 6/1987 Phlaphongphanich
4,688,571 A 8/1987 Tesler
4,700,856 A 10/1987 Campbell et al.
4,759,139 A 7/1988 Ricks
4,815,615 A 3/1989 Phlaphongphanich
4,832,214 A 5/1989 Schrader et al.
4,941,573 A 7/1990 Fuerstman
4,993,568 A 2/1991 Morifuji et al.
5,013,321 A 5/1991 MacVane
5,035,340 A 7/1991 Timmons
5,069,351 A 12/1991 Gunderson et al.
5,101,991 A * 4/1992 Morifuji et al. ..... 215/11.1
5,114,374 A 5/1992 Estiva
5,117,994 A 6/1992 Leblanc et al.
5,207,338 A 5/1993 Sandhu
5,322,031 A 6/1994 Lerner et al.
5,474,028 A * 12/1995 Larson et al. ..... 119/71
D371,848 S 7/1996 Searles
5,535,899 A 7/1996 Carlson
5,542,922 A 8/1996 Petterson et al.
5,544,766 A 8/1996 Dunn et al.
5,553,726 A 9/1996 Park
5,673,806 A 10/1997 Busnel
5,688,328 A 11/1997 Tong et al.
5,690,679 A 11/1997 Prentiss
D417,735 S 12/1999 Ford
6,003,698 A 12/1999 Morano
6,032,810 A 3/2000 Meyers et al.
6,161,710 A 12/2000 Dieringer et al.
6,241,110 B1 6/2001 Hakim
6,253,935 B1 7/2001 Fletcher
6,270,519 B1 8/2001 Botts
6,454,788 B1 * 9/2002 Ashton ..... 606/234
6,588,613 B1 7/2003 Pechenik et al.
6,736,830 B2 * 5/2004 Roust ..... 606/234
6,745,912 B2 * 6/2004 Uehara et al. ..... 215/11.1
2003/0089676 A1 5/2003 Uehara et al.
2003/0093120 A1 5/2003 Renz
2003/0093121 A1 5/2003 Randolph
2004/0045922 A1 3/2004 Holley, Jr.
2004/0144744 A1 * 7/2004 Holley, Jr. ..... 215/11.1

FOREIGN PATENT DOCUMENTS

EP 0 382 631 A 8/1990
EP 0 496 892 A 8/1992
EP 0 496 892 A1 5/2008
FR 2 700 689 7/1994
GB 347368 4/1931
GB 2 208 291 A 3/1989
JP 02-264660 10/1990
JP 2002-011076 A 1/2002
JP 2002011076 A * 1/2002
WO WO 86/06273 11/1986

* cited by examiner

ARTIFICIAL FEEDING NIPPLE TIP WITH VARIABLE FLOW CONSTRUCTION

This application claims benefit of U.S. Provisional Application No. 60/568,884, filed May 7, 2004.

FIELD OF THE PRESENT INVENTION

The present invention generally relates to an artificial nipple for use with a bottle for the purpose of feeding, such as an infant.

BACKGROUND OF THE INVENTION

The merits of breast-feeding are well documented in the scientific literature. A number of advantages have been noted which include nutritional, immunological, psychological and other general health advantages. A list of the merits of human breast milk as compared to artificial feed or formula would include ideal nutritional content, better absorption, fewer food related allergies, more favorable psychological development, better immunological defenses, and a substantial economic advantage. Another benefit to exclusive breast-feeding includes positive effects on development of an infant's oral cavity resulting in proper alignment of teeth and other related benefits.

For various reasons, however, exclusive breast-feeding is not always possible. An example of this would be where a nursing mother cannot produce enough breast milk to feed her infant. In such cases, an artificial feed may be used to supplement breast-feeding. A nursing mother returning to work may employ a breast pump to express milk to be given to her infant at a later time. In the event that an infant is fed with an artificial formula or previously expressed breast milk, it is conventional that a bottle provided with an artificial nipple is used to feed the infant.

The mechanical aspects of breast-feeding are significantly different compared to that of bottle-feeding. In breast-fed babies, the tongue action appears to be of rolling or peristaltic motion. However, the tongue action for bottle-fed babies is often considered to be more piston-like or a squeezing motion. In order to stop the abundant flow of milk from a bottle with an artificial nipple having a large hole in the end, infants might be forced to hold the tongue up against the hole of the nipple to prevent the formula from gushing forth. This abnormal activity of the tongue is referred to as tongue thrust or deviate swallow. When breast-fed babies are not sucking or swallowing, they may rest with the nipple moderately indented by the tongue, while bottle-fed babies rest with the teat expanded, i.e., indenting the tongue. The differences between the tongue movements and rest position of the tongue and breast-fed and bottle-fed babies are probably due to the properties of the artificial nipple.

In the past, artificial nipples were generally made of latex and had only one single aperture. The aperture could be enlarged or new apertures could be opened to increase the flow of fluid by using a device to distend the aperture or pierce the latex, such as a hot needle. Enlarging the existing aperture or adding new apertures is done to increase the flow rate necessary or desirable for the infant. The amount of milk a baby requires during feeding may vary by size (growth) of the baby, appetite or nourishment.

Silicone nipples have become increasingly popular. Silicone nipples have a propensity to easily tear. Therefore, enlarging the existing aperture, or opening additional apertures is not very feasible. Consequently, silicone nipples are offered in a variety of flow rates with additional or larger apertures.

The undesirable effects of existing artificial nipples include a relatively constant maximum flow rate as the baby applies suction pressure, or negative pressure, to the artificial nipple. The artificial nipple has to be replaced when an increase or decrease in flow rate is desired.

It would be desirable to have an artificial nipple that provides a variable flow rate responsive to changes in suckling, such as in negative pressure from the baby, in addition to reducing or eliminating the need for different artificial nipples for different flow rates. The present invention is believed to satisfy this desire, among other things.

SUMMARY OF THE INVENTION

An object of the invention is to provide an artificial nipple that permits milk to variably flow therefrom in response to varying breast-feeding conditions, such as suction levels. Yet another object of the invention is to provide variable flow rates in a single artificial nipple opening without any modification made to the nipple. Still another object of the invention is to provide an artificial nipple that has ducts and/or openings that are tailored to permit liquid flow depending upon suckling action (e.g., the amount of suckling force, pressure, etc.).

In one aspect of the present invention, a baby feeding apparatus includes a nipple with one or more ducts formed therethrough for conveying fluids through the nipple to an end opening (aperture, hole or orifice). In one form, the flow rate responds to the changes in suction (or negative pressure) the baby applies to the artificial nipple. In a particular aspect of the foregoing invention, the nipple may be a Shore A hardness of less than about 10, and even below 1 in the area of the duct openings or nipple holes. More particularly, on the Shore 00 scale, a range of about 20 to about 45 is presently considered most desirable. The nipple opening is sized to accommodate a first flow rate depending upon one or more suckling criteria, such as the sucking action of the infant (negative pressure), the extension of the nipple in the mouth, clamping force, and even other factors that affect the delivery rate. The material defining the nipple opening is tailored to expand the diameter of the opening for a greater flow rate when demanded, such as an increase in one or more of the foregoing criteria. The soft and very flexible material for the nipple described herein accommodates this variable dilation of the nipple opening.

The nipple may include one or more elongated ducts. The fluid ducts may further be offset radially with respect to a central axis of the nipple in another variation. Further still, the end openings of the ducts can be radially offset relative to the central axis of the ducts themselves. With respect to the concept of a dilating nipple opening, the number and arrangement of the openings are subject to wide variety, as desired.

In addition to the foregoing, it has been found, at least as a result of the use of the relatively low Durometer nipple material referred to herein, that other aspects of the nipple become useful in optimizing the overall function of the nipple and provide a useful adjustable parameter when designing and/or providing adjustments in nipple flow rate. Specifically, it becomes possible to adjust flow rate and the reaction of the nipple to changes in negative pressure by changing the duct length alone or, in the alternate, in combination with the nipple aperture diameter or other aspects of the nipple. It is believed, as is set out in more detail herein, that the low Durometer material allows the flow rate of the nipple to change as a function of the negative pressure applied thereto. In view of this finding and in contrast to prior art nipples, changing the axial length of the nipple ducts provides desirable changes to the flow characteristics through the nipple. Without wishing to be limited by theory, it is believed that a relatively shorter duct length will provide a wider range of flow in response to application of negative pressure. Because of the low Durometer nipple material, the nipple ducts are permitted to dilate in response to application of negative pressure to the nipple. If the nipple ducts are lengthened, the flow rate may be relatively lower or less changeable in response to application of negative pressure thereto because a greater length of duct(s) is required to dilate. Accordingly, it is possible and may be desirable to design the nipple to have a lesser or less changing flow amount by providing a relatively longer duct as opposed to changing the aperture diameter or Shore hardness of the nipple. Naturally, the effect of providing a longer or shorter duct in the present invention is expected to interact with the effect of providing differing Durometer nipple material and providing differing diameter nipple apertures, for example. Another interactive aspect of a preferred embodiment of the present invention includes elongation of the nipple during application of negative pressure thereto and a corresponding elongation of the ducts. The amount of elongation affects the flow characteristics due, in part, to the change in axial duct length as well as the change in radial cross sectional area.

In one embodiment, the nipple includes a unitary nipple portion and an integral mounting portion. The mounting portion may be formed of a material having the same Shore A hardness as that of the nipple portion, but in this embodiment, the mounting portion is formed of a material having a relatively higher Shore A hardness than that of the nipple portion. This provides a more rigid structure for attachment to a container, for instance.

In another form, the nipple may include a nipple end and a body portion. The body portion may include a vent formed therethrough, or multiple vents. The vent may include a horizontal passageway in communication with atmosphere, and a vertical passageway in communication at a first end to the horizontal passageway and at a second end to an inner chamber of the nipple.

Another aspect of the invention provides a substantially solid nipple being formed of a material having a Shore A hardness of less than about 10, and one or more expandable ducts and/or openings at or near the nipple tip or end for conveying fluids through the nipple end, and most preferably with the ducts extending through the generally solid nipple portion.

Of course, the nipple need not be a solid or substantially solid. The concept of a dilating orifice is effective in a conventional hollow design with the appropriate flexibility in the area defining the orifice.

Yet another aspect of the invention provides a baby feeding apparatus including a nipple having one or more elongated ducts formed therethrough for conveying fluids through the nipple, and a flow augment feature. One flow augment feature provides passage of fluids through the one or more ducts when the nipple is one or both of radially compressed and axially extended. The flow rate of the fluid responds to the changes in suction or negative pressure. The flow rate of the fluid can be tailored to respond proportionally, inversely, equally, or somewhere along this continuum, to the negative pressure. For example, as the infant increases suction on the artificial nipple, the duct and/or termini of the duct dilates and the flow rate of the fluid increases. As another example, as the infant decreases negative pressure on the artificial nipple, the duct and/or termini of the duct contracts and the flow rate of the fluid decreases.

The ducts may be round in cross-section, along with circular openings. The ducts may terminate in longitudinal slits. In yet another embodiment, the ducts may terminate in "S"-shaped slits or "Y"-shaped slits. Other possibilities exist.

A significant attribute of the present invention, in one form, is considered to be the very low Durometer material of the nipple end portion, and how that material behaves under manipulation by the infant in suckling, both in increased flow rate as with greater negative pressure and also in decreased flow rate with less negative pressure. The elongated duct(s) in a preferred substantially solid embodiment appear to react much more like a mother's nipple than any prior art artificial nipple with this very low Durometer material. The infant also is believed to engage the soft area surrounding and extending outwardly from the distal end of the extending portion in a manner much more reminiscent of feeding at the breast. Unlike prior art artificial nipples, the present invention permits the fluid flow characteristics of the nipple to respond to changes in negative pressure. The low Durometer material of the nipple, in combination with other features of the present invention, allows a higher fluid flow rate at, for example, a relatively increased negative pressure by the infant suckling.

As will be evident herein, the most preferred durometers for the soft and flexible nipple are considered to be in the range at or below about Shore A 5, which would be most preferably around Shore 00 20 to 45. Even below the latter range may be useful.

Another way to look at the desired result in this nipple insofar as extension and compression under suckling, is through the elongation of the nipple material. Materials that have appeared very useful for the elongated portion of the nipple have shown a stress of approximately 40 psi or less at 300% elongation in a most preferred embodiment.

In another form of the present invention, the tailored flow rate is accomplished through the use of multiple nipple ducts and/or openings having a variety of diameters. Each opening type has its own characteristic in terms of responding to suckling action. Certain ducts/openings can be adjusted to open only upon the application of a certain threshold negative pressure (suck), for example. Thus, for a younger baby, only certain ducts might carry fluid, while other ducts would open for an older baby applying more force, pressure, etc.

In this form of the invention, the multiple ducts and/or openings need not be formed in the very soft flexible material described with the dilating version, but could be designed with valving mechanisms or other fluid flow affecting mechanisms that respond differently to one or more suckling criteria, or a single kind of valving mechanism that responds differentially.

These, together with other objects and advantages will be further understood in the details of the construction and operation of the invention as more fully hereinafter described, reference being had to the accompanying drawings, forming a part hereof, wherein like numerals refer to like part throughout.

DESCRIPTION OF PREFERRED EMBODIMENTS

Figure 1:
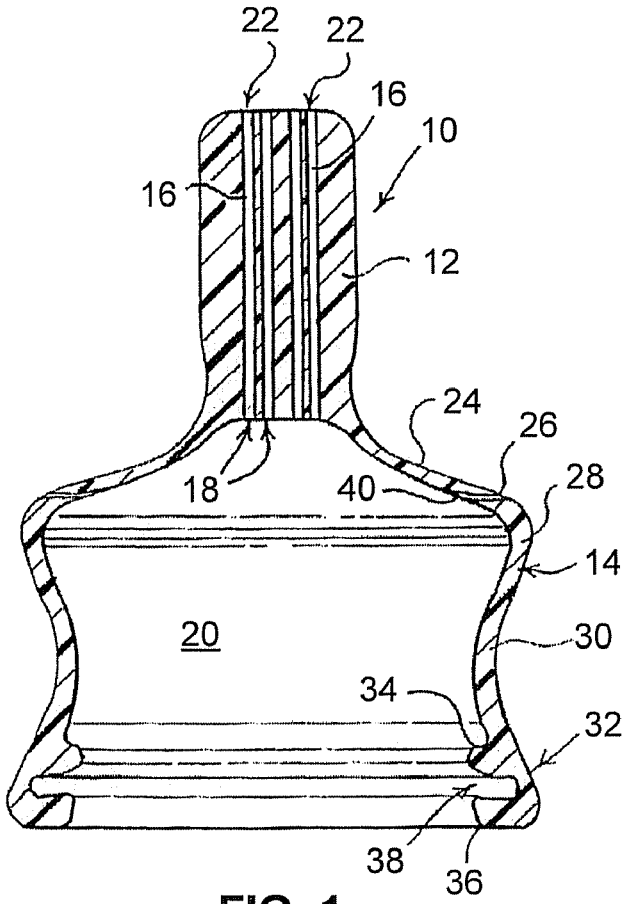
FIG. 1 is a sectional view of one embodiment of a nipple according to the present invention.

FIG. 1 shows an embodiment of a nipple, illustrated generally at 10, for use with a container, such as a bottle or bag. The nipple 10 may be made of any suitable material, but in a preferred form is made of a silicone material, such as silicone rubber. Preferably, the nipple material may be silicone, but could alternatively be other materials, such as thermoplastic elastomers (TPE's), such as polyisoprene, and others compatible for nursing.

It will be noted that, while described in the environment of human infant feeding, the invention has broader application to animal feeding, providing fluids to non-infants, and so on.

As shown in FIG. 1, the nipple 10 is formed of two subparts including a substantially solid nipple portion 12 at a proximal end thereof for insertion into an infant's mouth and for conveying fluids therethrough from an attached bottle (not shown). Proximal and distal, being indicative terms, are chosen here with respect to the user (e.g., the infant). The nipple portion is a generally cylindrical substantially solid body. However, it is understood that the nipple can be in other shapes such as "orthodontic" designs. The term "substantially solid", for purposes of the present application, is broadly defined as a range from completely solid (i.e., including no voids or hollows except for the existence of one or more generally narrow ducts for conveying fluid), to having a hollow interior defined by sidewalls that include one or more ducts formed therethrough where the ducts have a significantly greater longitudinal length than radial width. As will be appreciated, there are certain functional attributes for the "solid" nipple portion 12 of this aspect of the invention that do not require a completely solid construct. Moreover, the nipple of this invention need not be solid at all, that being one preferred version. In the first form of the invention described herein, the soft flexible material need only be provided in the area defining the hole(s) to obtain the benefit of the variable diameter duct and/or hole structure.

Preferably, the material of which the nipple portion 12 is fabricated has a Durometer A (or Shore A) hardness that is substantially within the range of about 1 to about 20. More preferably, the first material has a Durometer A hardness that is within the range of 1 to about 3, or switching to the Shore 00 scale, most preferably in the range of about 20 to about 45. Below the latter range is nonetheless also considered efficacious. It will be understood that the use of the phraseology "less than x" or "less than about x" includes x.

The nipple 10 includes a second subpart or mounting portion 14 formed at a distal end thereof, which is designed to be attachable to a container in a fluid-tight manner. Alternatively, a secondary collar or like attachment piece could be used to attach the nipple 10 to the container. The material of which mounting portion 14 is fabricated preferably has a Durometer A hardness that may be formed of the same or a greater Durometer hardness than nipple portion 12. In one embodiment, the mounting portion 14 has a Durometer A hardness that is within the range of about 1 to about 100. More preferably, the material of the mounting portion 14 has a Durometer A hardness that is substantially within the range of about 20 to about 90, or even more preferably in the range of about 70 to about 90.

The nipple portion 12 illustrated in FIG. 1 includes a plurality of ducts 16.

Any number of ducts 16 may be used, including just one. The ducts 16 are longitudinal (axial) passageways formed in the material of the nipple 12. Each duct includes an inner opening 18 in communication with an inner chamber 20 of the nipple 10. Each duct includes an outer opening 22 that is open to the exterior of the nipple. Fluid may flow from chamber 20, into inner openings 18, through ducts 16 and out through outer openings 22.

A flange-like skirt or transitional member 24 extends generally radially from the nipple portion 12 to an upper annular surface 26 of the mounting portion 14. The main body 28 of the mounting portion 14 may be formed of a gently concave cylinder 30, although this concavity is not required. A lower part 32 of the mounting portion 14 includes an inner lip 34 and a lower lip 36 with an inner groove 38 defined therebetween. The lower part 32 may be elastically deformed so as to be received on a container (not shown) and wherein the inner groove 38 is fitted over a corresponding mating feature on the container as in a snap-fit, screw attachment, and so on.

The nipple 10 may be formed as a single unitary part, or joined together from two or more parts. In this illustrated first embodiment, the nipple 10 is formed of two parts by a joint 40. Adhesive bonding, heat bonding, chemical bonding, contact molding, ultrasonic welding or any suitable method may hold the joint 40 together. It will be understood that any suitable method of forming the nipple 10 may be employed, such as molding, casting, or two-shot molding, for example.

Figure 2:
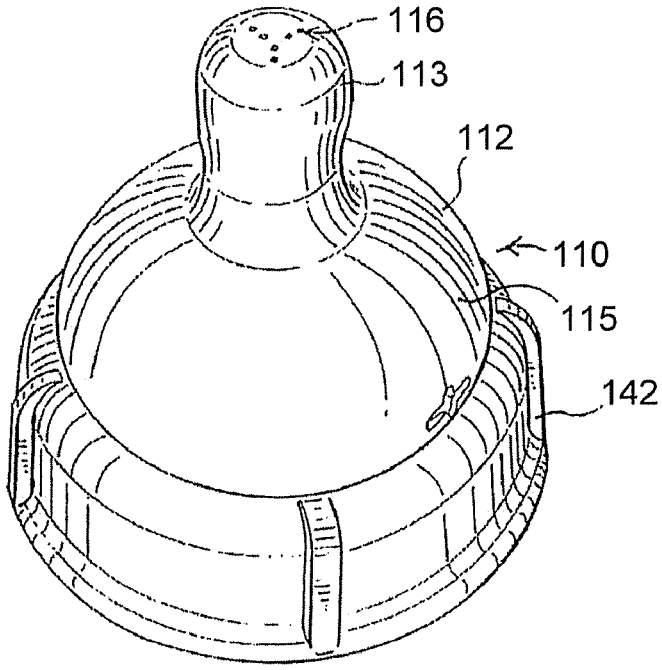
FIG. 2 is a perspective view of a second embodiment of a nipple according to the present invention.

FIG. 2 illustrates another slightly different embodiment and arrangement of the ducts 116. The ducts 116 number six individual ducts, although any suitable number of ducts is contemplated. The ducts are arranged in a triangular pattern, each vertice of the triangle similarly spaced from a middle or central axis of the nipple. Two ducts 116 comprise a set and are positioned so as to be arranged axially outwardly in a line from the central axis. Other arrangements of ducts are contemplated that effectively convey fluids through the nipple 110; this is just one such. As discussed below, the ducts 116 may terminate with a round hole, slit, chisel, "S"-shaped aperture or "Y"-shaped aperture (not shown), for example, or any suitable terminal aperture shape. The termination or terminal end of each of the ducts, whether a slit or other shape, may function as a valve.

In the illustrated embodiment of FIG. 2, the nipple 110 is also formed of a two-part construction. The nipple portion 112 again includes a substantially solid nipple end 113, which extends to a hollow, dome-shaped body 115. The nipple portion 112 is similar to that described above, i.e., a substantially solid nipple body including a plurality of ducts 116 extending therethrough. The body 115 flares outward from the base of the nipple 112 and connects to a collar .142 for connecting to a bottle (not shown).

Figure 3:
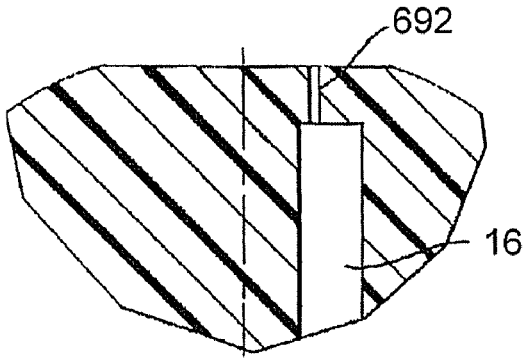
FIGS. 3 through 5 are enlarged sectional views of various nipple duct and opening shapes.
Figure 7:
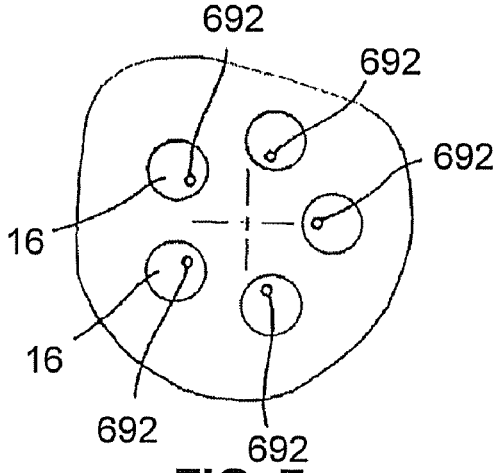

FIG. 3 shows another variation on a nipple end structure wherein the duct 16 (or indeed any of the other ducts described herein) has a generally cylindrical internal cavity terminating in a small diameter outlet 692. FIG. 7 shows an end-view of such a structure.

Figure 4:
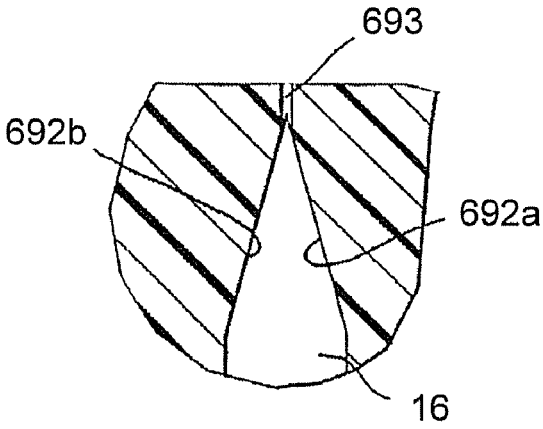
Figure 5:
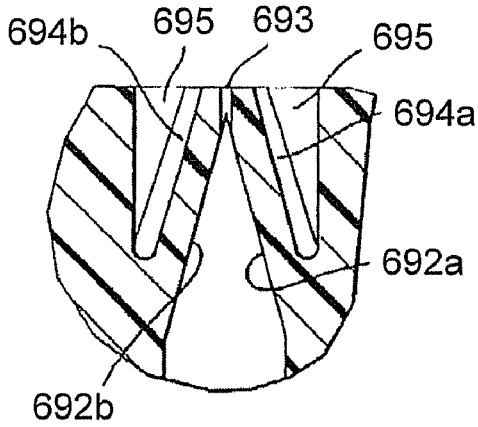
Figure 6:
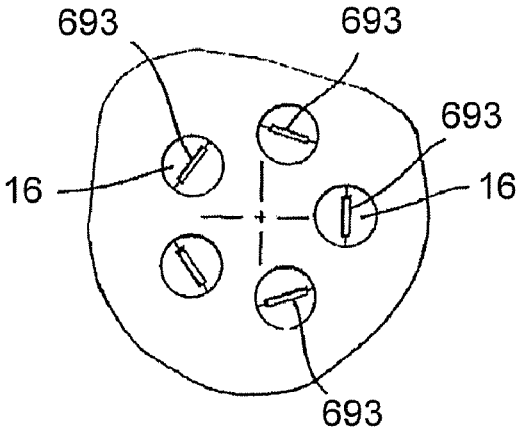
FIGS. 6 and 7 are various arrangements of certain nipple openings as seen from the inside of the nipple.

FIG. 4 shows a chisel-shaped terminus for the duct 16, with opposed sidewalls 692*a* and 692*b* which end in a slit 693, the latter shown in side view in FIG. 5 and end-view in FIG. 6.

FIG. 5 is yet another terminus structure for the nipple duct 16, this also having a chisel-shape 692*a* and 692*b* ending in a slit 693. Outboard sidewalls 694*a* and 694*b* defined within a well 695 give this structure a duck-bill configuration.

All of these terminal structures in FIGS. 4-6 serve as valves for allowing fluid flow out through the nipple, but generally (or substantially completely in certain structures) preventing flow back into the nipple.

Further details of the construction of a solid-type nipple of the foregoing type can be gleaned from co-pending application U.S. Ser. No. 10/696,910 filed Oct. 29, 2003, which is hereby incorporated by reference, although such reference is not deemed necessary in view of the disclosure already provided herein and nature of the present invention.

Figure 8:
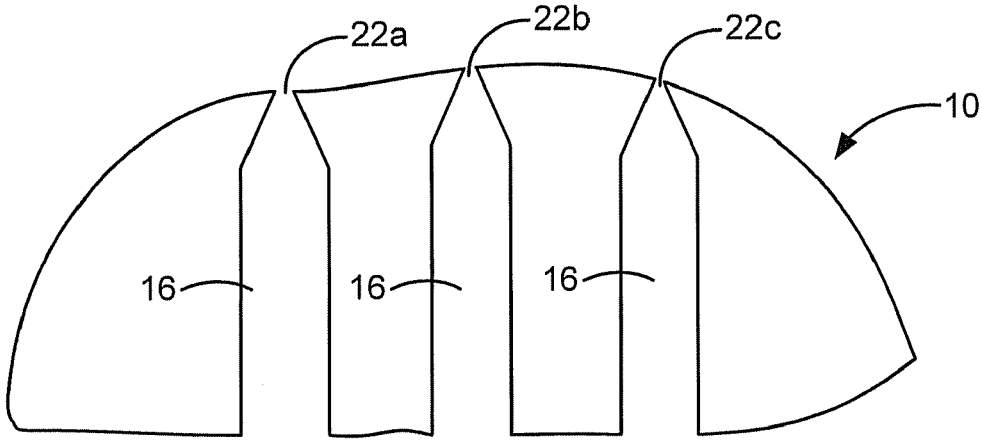
FIG. 8 is an enlarged and partially sectional illustration of a portion of another nipple end having various size openings.
Figure 9:
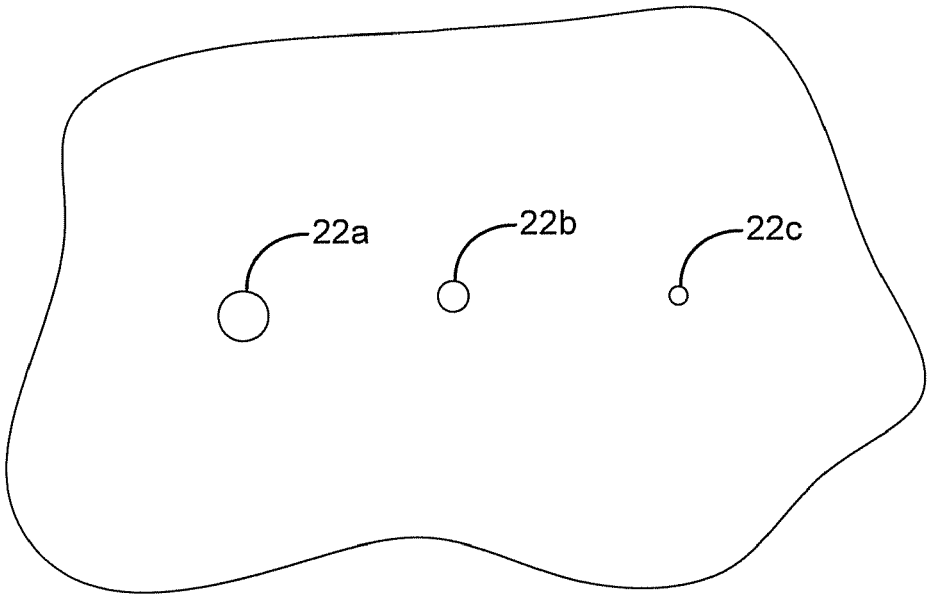
FIG. 9 is an enlarged top view of the embodiment of FIG. 8.

In another embodiment and form of the invention shown in FIGS. 8 and 9, the same multi-use concept can be effected using a variety of openings in the same nipple. In this form, openings 22*a*, 22*b* and 22*c* are provided, each with a different diameter. In this version, the same flexible and soft material is used as previously described, at least in the area defining the holes.

Figure 10:
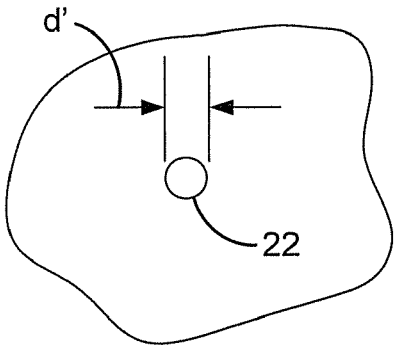
FIG. 10 is a top view of an enlarged portion of the nipple end showing a hole in a first condition.
Figure 11:
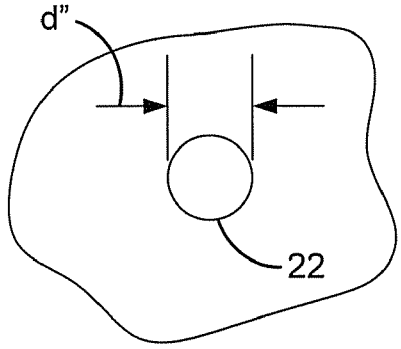
FIG. 11 is the same top view of FIG. 10, with the hole in a second condition.

Turning now to FIG. 10, a nipple duct opening (aperture, terminus or hole) is shown in a first condition, such as where fluid is to flow under a condition of a first level of applied suck or pull of the infant. In this first condition, opening 22 has a diameter d'. Upon application of a second level of applied suck or pull of the infant that is greater than the first level, the opening 22 then expands to a greater diameter d", (see FIG. 11) allowing more fluid flow. The soft flexible material described herein can permit this variation in hole diameter.

As noted above, a variety of criteria may be established in terms of the duct and/or end opening to determine the rate of fluid flow desired. This permits a single nipple to be tailored to enable use along a spectrum of suckling conditions.

However, it will be understood that this variety in openings, as well as any associated ducts, could be provided in a conventional hard or non-flexible nipple. The structure of the openings and/or ducting would accordingly be adapted to variously permit fluid flow, as by the use of valving, or even simply fluid-flow resistance, depending on one or more suckling criteria. For example, the duck-bill type structure shown in FIG. 5 could be modified in each instance to open only upon the application of a certain or predetermined level of negative pressure. Some would allow flow under a first pressure level, while others would allow flow upon reaching a second level.

Figure 12:
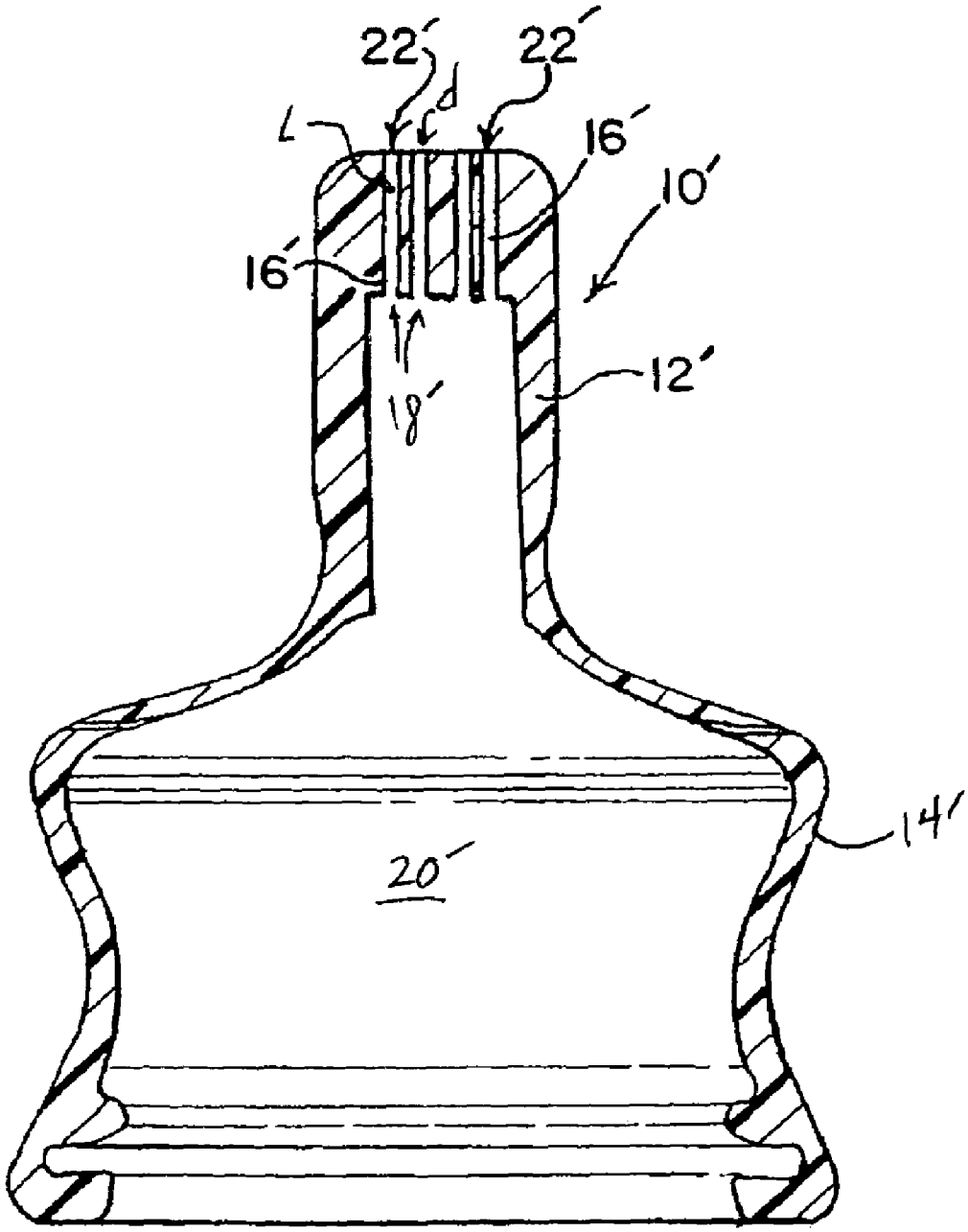
FIG. 12 is another embodiment of the invention.

FIG. 12 shows nipple 10' formed of two subparts including a substantially solid nipple portion 12' at a proximal end thereof. The nipple 10' includes a second subpart or mounting portion 14' formed at a distal end thereof. The nipple portion 12' illustrated includes one or more ducts 16'. The ducts 16' are longitudinal (axial) passageways having a length L. Each duct 16' includes an inner opening 18' in communication with an inner chamber 20' of the nipple 10'. Each duct includes an outer opening 22' having a diameter d that is open to the exterior of the nipple. Fluid may flow from chamber 20', into inner openings 18', through ducts 16' and out through outer openings 22'.

Figure 13:
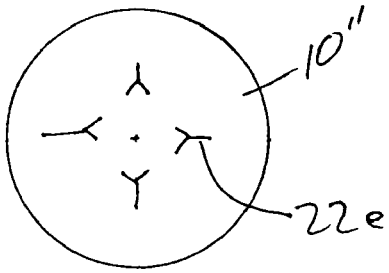
FIG. 13 shows "Y" shaped openings.
Figure 14:
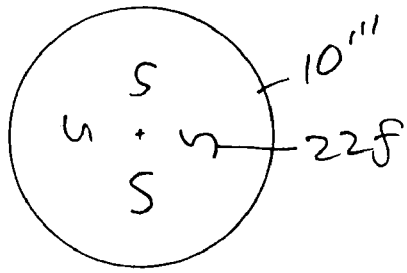
FIG. 14 shows "S" shaped openings.
Figure 15:
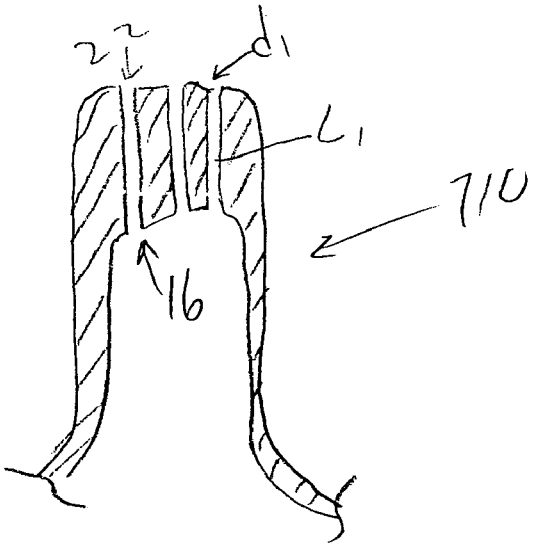
FIG. 15 shows a nipple according to an embodiment of the invention with openings and ducts having diameters and lengths according to an initial condition.
Figure 16:
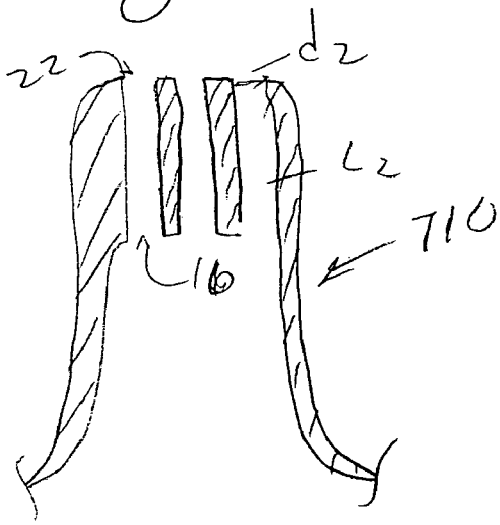
FIG. 16 shows the nipple of FIG. 15 with openings and ducts having diameters and lengths being widened and lengthened respectively.

FIG. 13 shows "Y" shaped openings and FIG. 14 shows "S" shaped openings. FIG. 15 shows a nipple 710 according to an embodiment of the invention with openings 22 and ducts 16 having diameters d1 and lengths L1 according to an initial condition; and FIG. 16 shows the nipple 710 of FIG. 15 with openings 22 and ducts 16 having diameters d2 and lengths L2 being widened and lengthened respectively.

Thus, while the invention has been described with respect to certain preferred embodiments, it will be understood by those of skill in the art that there are modifications, substitutions and other changes that can be made, yet will still fall within the intended scope of the invention, as set forth in the following claims.

What is claimed is:

1. An improved feeding nipple, comprising:

a nipple body having at least one nipple opening formed therethrough for conveying fluids through said nipple, wherein a majority of said nipple body is solid, and wherein said nipple body has a Shore A hardness of less than about 10, at least in an area proximate said opening, and wherein said nipple opening changes in size in response to changes in pressure applied to said nipple; and one or more elongated duct extending through said nipple body having a length to width ratio greater than one, said elongated duct being in fluid communication with said nipple opening.

2. The nipple of claim 1, wherein said at least one nipple opening changes in size to provide the varying flow rates.

3. The nipple of claim 1, wherein said nipple opening is sized to accommodate a predetermined flow rate depending upon one or more suckling criteria.

4. The nipple of claim 3, wherein said suckling criteria is based on a range of negative pressure generated by the sucking action of an infant.

5. The nipple of claim 1, wherein said nipple opening dilates when subjected to negative pressure.

6. The nipple of claim 1, wherein said elongated ducts are offset radially with respect to a central axis of said nipple.

7. The nipple of claim 1, wherein elongation of the elongated duct changes axial length and radial cross sectional area of the elongated duct.

8. The nipple of claim 1, wherein changes in flow rates is accomplished by permitting said opening to dilate.

9. The nipple of claim 1, wherein changes in flow rates is accomplished by permitting said one or more duct to elongate.

10. The nipple of claim 1, wherein changes in flow rates is accomplished by permitting said opening to dilate and said one or more duct to elongate.

11. The nipple of claim 1, wherein said one or more elongated duct functions as a flow augment feature.

12. The nipple of claim 11, wherein each of said openings is a round opening.

13. The nipple of claim 11, wherein each of said one or more ducts includes a S-shaped slit at a terminus thereof.

14. The nipple of claim 11, wherein each of said one or more ducts includes a Y-shaped slit at a terminus thereof.

15. The nipple of claim 1, wherein said nipple has a Shore A hardness of less than about 1, at least in an area proximate said opening.

16. The nipple of claim 1, wherein said nipple has a Shore 00 hardness of about 20 to about 45, at least in an area proximate said opening.

17. The nipple of claim 1, wherein the flow rate varies in proportion to the negative pressure.

18. A nipple, comprising:

a substantially solid nipple portion adapted to be inserted into the mouth of a user and being formed of a material having a Shore A hardness of less than about 10;

at least one variable opening defined in an end of said nipple portion; and one or more elongated duct having a length to width ratio greater than one, said elongated duct being in fluid communication with said nipple opening.

19. The nipple of claim 18, wherein said at least one variable opening conveys varying fluid rates through said nipple.

20. A nipple, comprising:

a substantially solid nipple sized and shaped to be inserted into the mouth of a user wherein said nipple has a Shore A hardness of less than about 10;

a plurality of openings defined in an end portion of said nipple, with at least one of said openings supplying fluid at a different rate than another of said plurality of openings; and elongated ducts extending through said nipple having a length to width ratio greater than one, an elongated duct being respectively in fluid communication with one of said plurality of openings, said ducts and openings remaining in an open condition when said nipple is not in use.

* * * * *